United States Patent [19]

Nakagami et al.

[11] Patent Number: 4,922,294

[45] Date of Patent: May 1, 1990

[54] IMAGE FORMING APPARATUS

[75] Inventors: Hidekazu Nakagami; Masashi Sakamoto; Hiroshi Ozawa, all of Osaka, Japan

[73] Assignee: Minolta Camera Kabushiki Kaisha, Osaka, Japan

[21] Appl. No.: 266,848

[22] Filed: Nov. 3, 1988

[30] Foreign Application Priority Data

Nov. 5, 1987 [JP] Japan ..... 62-280678

[51] Int. Cl.[5] ..... G03G 21/00

[52] U.S. Cl. ..... 355/209; 355/206; 355/204

[58] Field of Search ..... 355/204, 205, 206, 209, 355/244, 326

[56] References Cited

U.S. PATENT DOCUMENTS

| | | | |
|---|---|---|---|
| 4,538,267 | 9/1985 | Uchida | 355/209 X |
| 4,597,662 | 7/1986 | Hirata et al. . | |
| 4,603,962 | 8/1986 | Dekura . | |
| 4,647,185 | 3/1987 | Takeda et al. | 355/209 |
| 4,682,158 | 7/1987 | Ito et al. | 355/209 X |
| 4,724,462 | 2/1988 | Yamasaki et al. | 355/206 |
| 4,804,998 | 2/1989 | Miyawaki | 355/206 |

FOREIGN PATENT DOCUMENTS

0085975-A2 8/1983 European Pat. Off. .

*Primary Examiner*—A. T. Grimley
*Assistant Examiner*—Sandra L. Hoffman
*Attorney, Agent, or Firm*—Burns, Doane, Swecker & Mathis

[57] ABSTRACT

An image forming apparatus equipped with a sensor for detecting the requirement of replenishment and exchange of expendable supplies, parts and the like and an image forming structure capable of forming on the same sheet of paper a prewarning image in addition to a regular image formed corresponding to an original or image information to be copied.

The image forming structure receives different control depending on whether or not the sensor is detecting the requirement of replenishment and exchange, wherein if the sensor is not detecting the requirement, it forms only a regular image while when the sensor detects the requirement, it forms a prewarning image together with a regular image thereby indicating the requirement of replenishment and exchange by the prewarning image on the same sheet on which a regular image is formed.

6 Claims, 8 Drawing Sheets

IMAGE FORMING APPARATUS

BACKGROUND OF THE INVENTION

1. Technical Field of the Invention

The present invention relates to an image forming apparatus having a prewarning function for previously warning the periodic requirement of manual handling for replenishing expendable supplies as well as for exchanging parts to be exchanged, and more particularly to an image forming apparatus designed to previously give warning of the requirement for replenishment and exchange of expendable supplies and parts such as thermo-sensitive roll sheets being used in a facsimile, developer, sheets, cleaning webs, waste toner bottles used in an electrophotographic image forming apparatus and heat transfer ribbons used in a heat transfer system image forming apparatus.

2. Brief Description of the Prior Art

Heretofore, the warning of requirement for replenishment and exchange of expendable supplies and parts is given, for instance, by means of a line mark arranged on side edge of the rear end of a thermo-sensitive roll paper used in a facsimile or by an indication displayed on the operation panel of an electrophotographic copying machine and the like.

However, the warning is generally given at the final stage when such replenishment and exchange is required to be made. Thus, for a facsimile and the like which are often used at nighttime and during holidays when there is nobody in the office, the warning for replenishment and exchange is entirely useless even if such warning signal is emitted automatically and causes the machines incapable of functioning since there is no one who handles the replenishment and the exchange.

It may hence be considered to preliminarily give warning for replenishment and exchange by moving up the final stage or to arrange for giving the warning when the number of the remaining sheets is reached to predetermined number. However, when the mark provided at the rear end of a roll sheet is applied to a cut sheet originally cut in a predetermined size, the sheet specially provided with such a mark has to be prepared and set at near end portion of the sheets being used, which is quite troublesome, and moreover it can not tell the requirement of, for instance, toner replenishment and the like by such a roll sheet provided with mark, excepting the sheet replenishment.

Further, in an image forming apparatus in which various indications are made on an operation panel, such indication of warning is only one of the indications among complicated and various indications, and operators are liable to overlook the indication since such indication is not closely familiar with the operators except when the machine is operated. There leaves, therefore, problems for a facsimile and the like which are often used when there is nobody around.

SUMMARY OF THE INVENTION

The main object of the present invention is to provide an image forming apparatus capable of eliminating the inconveniences arising from failure in timely replenishment and exchange of expendable supplies and auxiliary parts by forming a prewarning image which is distinguishable from a regular image on the same sheet on which a regular image is formed corresponding to an original or other image data so that operators can easily recognize whether a prewarning image is on the sheet or not while confirming the regular image. The prewarning image is formed on a sheet whether it is a roll sheet or a cut sheet whenever manual handling is necessary to be made.

Another object of the present invention is to provide an image forming apparatus capable of indicating prewarning more advantageously by forming a prewarning image in different color from that of a regular image so that the prewarning image is easily recognized.

Still another object of the present invention is to provide an image forming apparatus capable of forming a regular image and a prewarning image in different color at one image forming operation by the same image forming means simply and without taking any further time of prolongation.

Further object of the present invention is to provide an image forming apparatus capable of complying with various changes of condition wherein a prewarning against several different conditions is selectively indicated.

Still further objects and features of the present invention will become more apparent from the following description taken in conjunction with the accompanying drawings which illustrate specific embodiments of the present invention.

BRIEF DESCRIPTION OF THE DRAWINGS

FIG. 10 is a schematic structural view illustrating the third embodiment of the present invention applied to a copying machine wherein a plurality of near-empty conditions can be complied with.

It is to be noted like members and parts are designated by like reference marks throughout the accompanying drawings and that repeated description is omitted.

DETAILED DESCRIPTION OF THE INVENTION

Some of the embodiments of the present invention will now be described below referring to the accompanying drawings.

FIGS. 1 through 4 illustrates the first embodiment of the present invention applied to a laser beam printer. The printer applied in this embodiment is a type capable of forming an image in two colors by one image forming operation.

Figure 1:
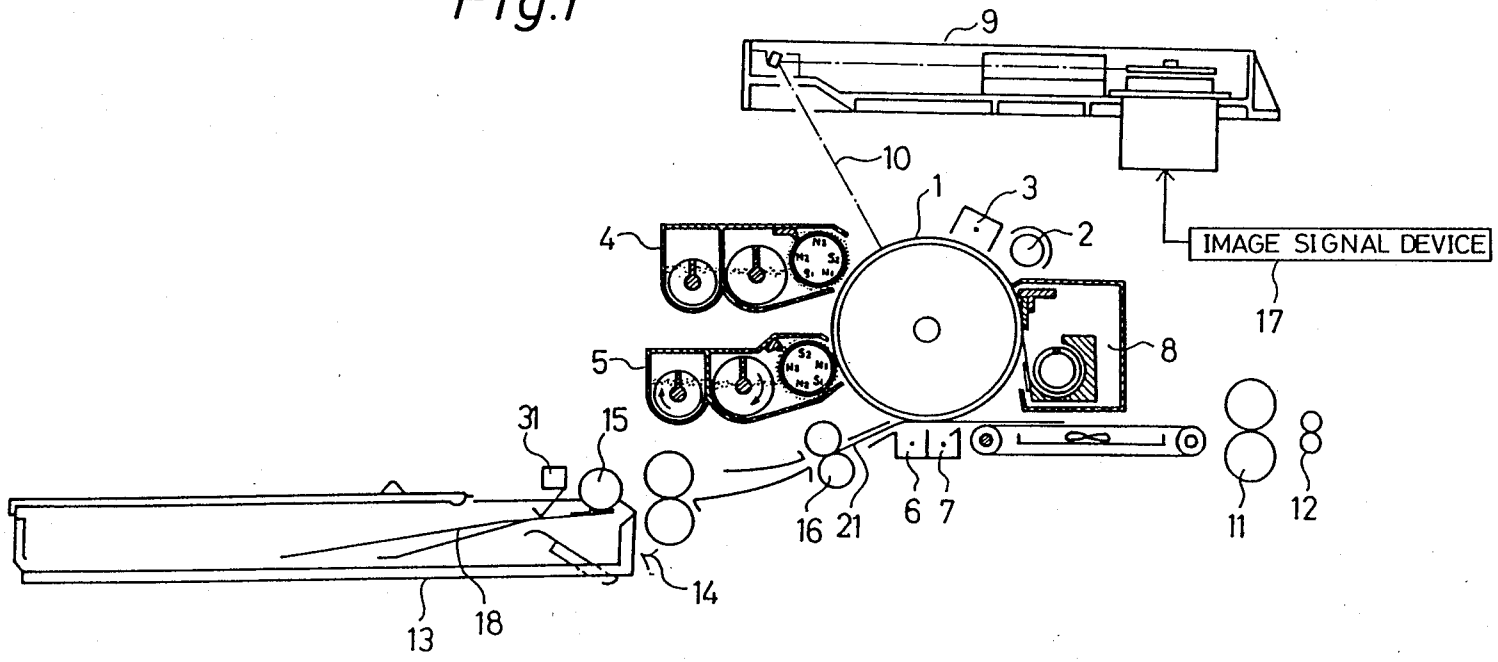
FIG. 1 is a schematic structural view showing the first embodiment of the present invention applied to a laser beam printer.

Around a photoconductive drum 1, as shown in FIG. 1, a main eraser lamp 2, a charger 3, a first and second developing units 4,5 provided for two-color development, a transfer charger 6, a separation charger 7 and a cleaning device 8 are sequentially disposed in the rotatively driving direction of the photoconductive drum 1 thus forming an image forming section thereat.

Above the photoconductive drum 1, a laser beam print head 9 is provided for irradiating a laser beam 10 modulated corresponding to an image signal emitted from an image signal device 17 of an image reader and the like onto the surface of the photoconductive drum 1 uniformly charged by the charger 3. Accordingly, an electrostatic latent image is formed on the surface of the photoconductive drum 1 corresponding to the image signal. The electrostatic latent image is then developed into a toner image by either one of the first or second developing units 4,5 or by both of the developing units and is thereafter transferred onto a transfer sheet 21 simultaneously transported by the transfer charger 3 thereby forming an image on the transfer sheet 21.

After transfer, the transfer sheet 21 is transported to a fixing device 11 after separated from the photoconductive drum 1 by the separation charger 7. The image on the transfer sheet 21 is fixed by the fixing device 11 and then the sheet 21 is discharged out of the copying machine by a discharge roller 12.

The toner remained on the surface of the photoconductive drum 1 after transfer is removed by a cleaning device 8 and residual charge is erased by a main eraser lamp 2 to get ready for next image forming precedure.

The sheets 21 are cut in a predetermined size and accommodated in a cassette 13 which is set in a paper feed section 14. In a paper feed section 14, the sheets 21 accommodated in the cassette 13 are fed one by one each time when image forming operation is performed by a paper feed roller 15 which is rotatively driven and then transported by a register roller 16 for the transfer taking positional timing with a visual image on the photoconductive drum 1.

The sheets 21 in the cassette 13 are successively consumed by image forming operation, resulting in emptying the cassette. It is, therefore, preferable to previously replenish the sheets 21 since no further image forming operation can be carried out under the circumstance. When a multiplicity of printings are successively made, it is subjected to encounter emptiness of the cassette if replenishment of the sheet is delayed, and the printing has to be suspended in order to replenish the sheets for continuing on the printing again, which is quite troublesome and successive, speedy printing can not be performed.

A near-empty detecting sensor 31 for detecting near-empty state of the sheet 21 is therefore provided, and the image signal device 17 is arranged to give a prewarning image signal which preliminarily indicates near-empty state to the print head 9 only when a near-empty signal is emitted by the sensor 31. Thus, a prewarning image is distinguishably printed together with a regular image onto the sheet 21 when near-empty state is detected.

The sensor 31 is arranged to be forcibly actuated when a sheet push up plate 18 disposed inside the cassette 13 is moved upwardly by making use of the decrease in number of sheets accommodated therein. In this embodiment, when about 20 sheets of paper are left in the cassette, the sensor 31 is directly actuated by the sheet push up plate 18 thereby emitting near-empty detecting signal. The replenishment of the sheet 21 can thus be made properly and sufficiently before the cassette is emptied.

Figure 6:
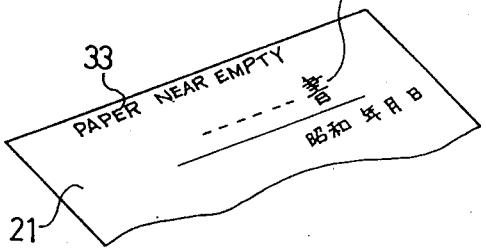
FIGS. 5 through 7 are perspective views illustrating examples of indications of prewarning images formed by the printer in FIG. 1.
Figure 5:
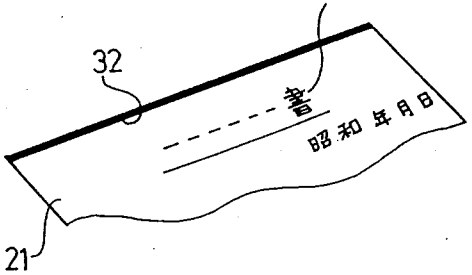
Figure 7:
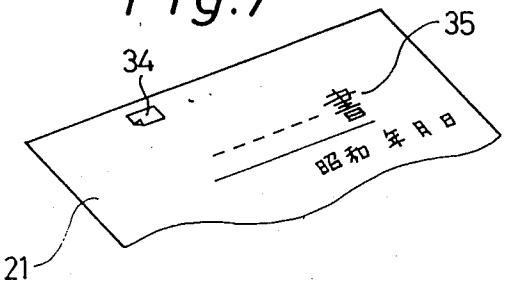

As a prewarning image, a line mark 32 shown in FIG. 5 or characters 33 in FIG. 6 or a hieroglyphic mark 34 shown in FIG. 7 may be used. With regard to the position where the prewarning image is to be printed, it can advantageously be printed on an edge of the sheet 21 as illustrated in the drawings since the image does not interfere with the formation of a regular image 35. and moreover the prewarning image is clearly and surely recognized when it is appeared on the sheet. When the sheet 21 is filed after print, the position where the prewarning image is printed may be used for punch holes or for book binding so that the image does not give any bad effect for the regular image.

Figure 2:
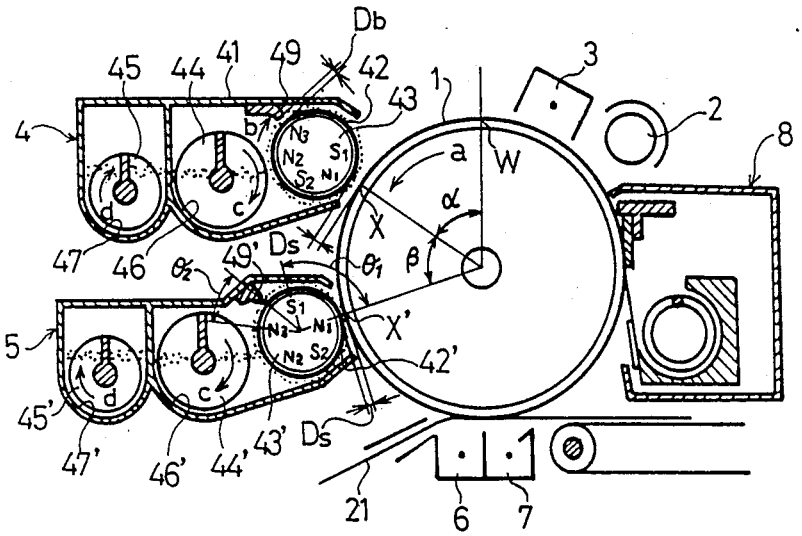
FIG. 2 is an expanded sectional view of a developing unit in FIG. 1.

This embodiment includes simultaneous two-color print function by utilizing the first and second developing units 4,5 which will now be described. To begin with, the structure of the developing units 4,5 will be described. The first developing unit 4 and the second developing unit 5 are constructed almost in the same structure as shown in FIG. 2. In a developer tank 41, a developing sleeve 42, a feed roller 44 and a screw 45 are sequentially disposed from the side of the photoconductive drum 1. In the first developing unit 4, a developer consisted of magnetic carrier and insulation color toner is accommodated, and in the second developing unit 5, a developer consisted of magnetic carrier and generally used insulation black toner is accommodated.

The developing sleeve 42 is made of a nonmagnetic conductor in cylindrical shape ($\phi$24.5 mm) and fine concave and convex are formed on its circumference by sandblast treatment. Each of the developing sleeves 42,42' in the developing units 4,5 is facing the photoconductive drum 1 at the position of developing areas X,X' with a developing gap: Ds (=0.6 mm), and the angles of rotation of the photoconductive drum 1 from exposure point W to the developing areas X,X' are predetermined as $\alpha$, $\alpha+\beta$ respectively, wherein $\alpha$ is 56° and $\beta$ 52°.

On the back of the developing area X in the developing sleeve 42, a height regulating member 49 disposed inside upper portion of the developer tank 41 is facing with a height regulating gap: Db (=0.4 mm).

Inside the developing sleeve 42, a magnet roller 43 in which a plurality of magnets are extendedly provided in the axial direction is disposed, and the magnetic force of the magnetic pole ($N_1$-$N_3$, $S_1$, $S_2$) positioned at the circumference of the magnets are predetermined as; $N_1$=1000G, $N_2$,$N_3$=500 G and $S_1$,$S_2$800 G respectively, wherein G represents gauss.

The center of the magnetic pole $N_1$ is disposed at the position moved by $\theta_1$ (80°) from the center of the magnetic pole $S_1$ in the clockwise direction as shown in the second developing unit 5, and the magnetic pole $N_3$ is disposed at the position moved by $\theta_2$ (40°) from the point facing the height regulating member 49 in the counterclockwise direction.

Figure 3:
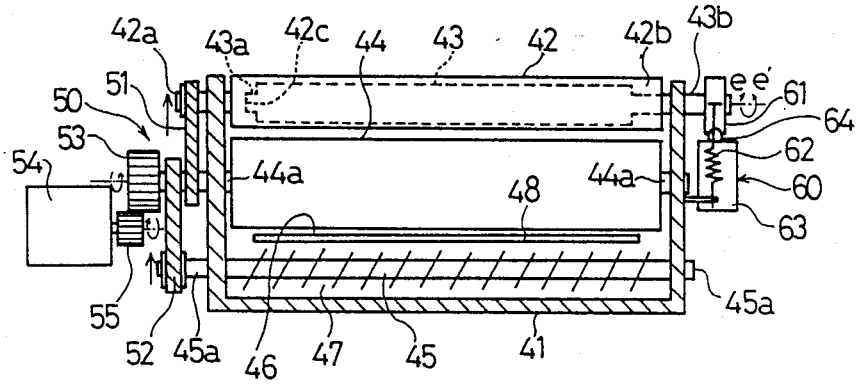
FIG. 3 is a plan view of the developing unit shown in FIG. 2.
Figure 4:
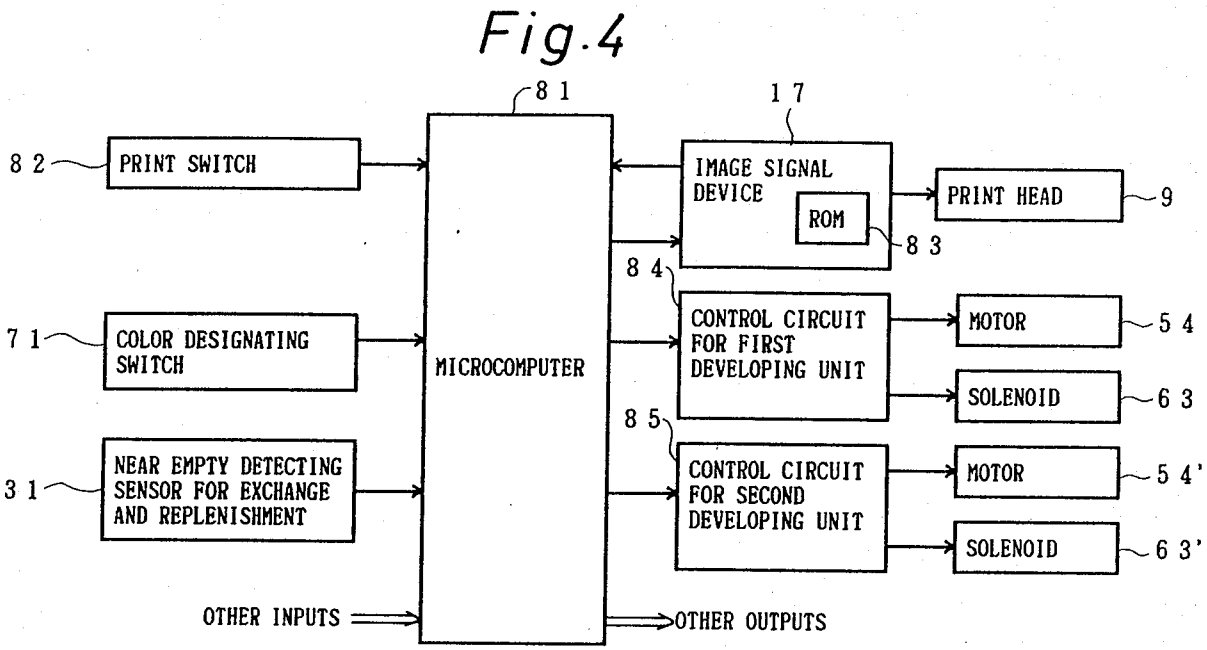
FIG. 4 is a block diagram of control circuit of the printer in FIG. 1.

One end 43*a* of a shaft of magnet roller 43 is supported at the bearing convex portion 42*c* provided inside the developing sleeve 42 as shown in FIG. 3 and another end 43*b* of the shaft is supported by the side walls of the developer tank 41, and is arranged movable at a predetermined angle ($\theta_2$=40°) by transporting means 60 which will be described below.

A bearing portion 42b at the right side in FIG. 3 of the developing sleeve 42 is supported by the shaft 43b of the magnet roller 43, and a shaft 42a at the opposite side is supported by the side walls of the developer tank 41 to be rotatatively driven by a driving means 50.

A feed roller 44 and a screw 45 are disposed on the transport paths 46 and 47 partitioned by a petition 48, and their shafts 44a and 45a are supported by the side walls of the developer tank 41 and are arranged to be rotatively driven by a driving means 50. The transport paths 46 and 47 are connected at both sides of the developer tank 41 as shown in FIG. 3.

The driving means 50 for the developing units 4,5, the feed roller 44 and the screw 45 will now be described. As illustrated in FIG. 3, the shaft 42a of the developing sleeve 42 and the shaft 44a of the feed roller are tied with a belt 51, and the shaft 44a of the feed roller 44 and a shaft 45a of the screw 45 are also tied with a belt 52. At the end of the shaft 44a of the feed roller 44, a gear 53 is attached which is engaged with a drive gear 55 of a motor 54. Thus, once the drive gear 55 is rotated by the motor 54 in the direction of solid line shown in FIG. 3, the gear 53 and the belts 51,52 are moved in the direction of solid lines respectively, and the developing sleeve 42, the feed roller 44 and the screw 45 are consequently rotated in the directions of arrow b,c and d respectively. The developing sleeve 42 is arranged to rotate at 240 rpm.

As shown in FIG. 3, a moving means 60 of the magnet roller 43 comprises a lever 61, a spring 62 and a solenoid 63, and the lever 61 is fixed to the end of the shaft 43b of the magnet roller 43, and the end of the lever 61 is attached to the spring 62 fixed on a developer tank 41 and biased always in the direction of arrow e. At the another end of the lever 61, a plunger 64 of the solenoid 63 is hooked thereto and is arranged to rotate the lever 61 against the energized force of the spring 62 in the direction of arrow e' when the solenoid is driven. Thus, when the solenoid 63 is not in action, as shown by the second developing unit 5 in FIG. 2, the magnetic pole $N_1$ of the magnet roller 43' is faced with the photoconductive drum 1 thereby making a developing area thereat while the magnetic pole $N_3$ is moved by $\theta_2$ (40°) in the counterclockwise direction from the position faced with the height regulating member 49'.

Conversely, when the solenoid is in action and the lever 61 is at the state shown in FIG. 3, the magnetic pole $N_3$ is faced with the height regulating member 49, as shown by the first developing unit 4 in FIG. 2, while middle portion between the magnetic poles $N_1$ and $S_1$ is faced with the photoconductive drum 1 thus making the area undevelopable.

By selectively utilizing the two developing units 4,5, black printing by the first developing unit 4 with black toner or color printing by the second developing unit 5 with color toner is carried out. In order to carry out such printings, a color designating key 71 is provided for selecting color printing (FIG. 4), and when the key 71 is operated, the color printing is performed, and when the key is not operated, black printing is carried out. In one printing operation, both the black printing and the color printing can selectively be accomplished on one sheet of paper divided into more than two printing areas by selectively utilizing the first developing unit 4 and the second developing unit 5. In this embodiment, when the prewarning image is printed by the function described above, the development is made in different color from that of a regular image so that the prewarning image can be more easily recognized.

In order to control the printing action, a control device 81 such as a microcomputer is provided and a print switch 82, a near empty condition detecting sensor 31 and the color designating key 71 are connected to the input section, and to the output section, the motor 54 of the first and second developing units 4,5, and control circuit 84,85 of the first and second developing units for controlling the solenoid 63 are connected. An image signal device 17 is also connected to the input and output sections of the control device 81 for controlling the print head 9 in accordance with an image signal. The image signal device 17 has a memory 83 for storing image data corresponding to the prewarning image and emits a signal to the print head 9 to form a prewarning image in compliance with a command from the control device 81.

An action for forming a prewarning image will now be described below. The component parts of a second developing unit 5 are distinguished with the mark (').

Once a main switch (not shown) of a printer is turned on, the middle portion between the magnetic pole $N_1$ and $S_1$ in a first developing unit 4 is faced with the photoconductive drum 1 as shown in FIG. 2, while the magnetic pole $N_1$ of the second developing unit 5 is faced with the photoconductive drum 1 shown in FIG. 2.

Under such circumstance, when the print switch 82 is turned on and if the key 71 is not operated, the second developing unit 5 containing black toner is automatically driven and the standard printing, i.e. black printing operation is performed, however, in case the key 71 is operated, the first developing unit 4 is driven to perform color printing. If the print switch 82 is turned on without operating the key 71, a developing motor 54' of the second developing unit 5 is started and a developing sleeve 42', a feed roller 44' and a screw 45' are rotatatively driven in the direction of arrows b, c and d. Thus, the developer containing black toner accommodated in a developer tank 41' is mixed and stirred by the rotation of the feed roller 44' and the screw 45', and is circularly transported through transport paths 46', 47', wherein some of the developer is fed onto the surface of the developing sleeve 42' by the feed roller 44' thereby forming magnet brush on the developing sleeve 42'.

The magnet brush passes through the height regulating gap Db with the height regulated by a height regulating member 49' corresponding to the rotation of the developing sleeve 42' and is successively fed to the developing area X' to get ready for development of an electrostatic latent image on the photoconductive drum 1. Corresponding to the action of a print switch 82 after it is turned on, an image signal device 17 is operated, and a laser beam corresponding to an image signal is irradiated onto the surface of a photoconductive drum 1 from a print head 9 thus forming an electrostatic latent image of a regular image. The electrostatic latent image is then developed by the second developing unit 5 and black printing is performed for a regular image since the key 71 is not operated.

When a detecting signal becomes H (FIG. 8 b ) upon detecting a near empty state by a sensor 31 during printing of a plurality sheets of paper, i.e. when a printing signal (FIG. a ) is H, a control device 81 gives a prewarning image printing command to the image signal device 17 so that exposures for a prewarning image are done corresponding to an image data stored in memory 83 before respective exposures on a regular images of successive print cycles.

The electrostatic latent image of a prewarning image thus formed by the exposure is first developed in color by actuating the first developing unit 4, and then the electrostatic latent image of a regular image is developed in black by the second developing unit 5.

Detailed description on how to selectively utilize the developing units 4,5 will now be made below.

After exposure on the prewarning image is started, the first developing unit 4 is actuated waiting for the time ($t_1$=0.22 sec) until a front edge of an electrostatic latent image on the photoconductive drum 1 moves from the position of exposure point W to the position of developing area X of the first developing unit 4, then the warning image portion of the latent image is developed in color. The development by the first developing unit 4 is continued until the boundary line between a prewarning image and a regular image in the electrostatic latent images reaches the developing area X (FIG. 8 e ).

When the time $t_1$ elapses from the start of the exposure on the regular image which follows completion of an exposure on a prewarning image, the boundary line of the electrostatic latent images reaches the developing area X and a first developing motor 54 is turned off, and at the same time, the solenoid 63 of the first developing unit is turned on to complete the development in color of the prewarning image in an electrostatic latent image.

Figure 8:
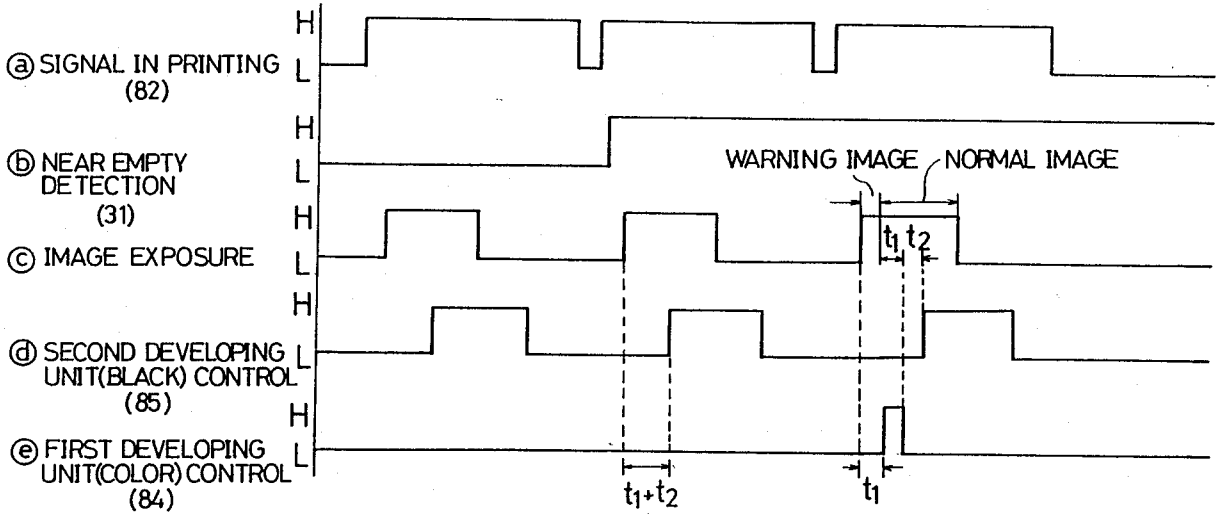
FIG. 8 is a time chart showing how the printer in FIG. 1 is operated including procedures how it works at the time when sheets are detected almost empty.

Further, after the lapse of the time $t_2$, during which the boundary line of the electrostatic latent image moves from the developing area X to the developing area X' of the second developing unit 5, a second developing motor 54' is turned on and the solenoid 63' of the second developing unit is turned off to start the development in black of the regular image (FIG. 8 d ).

In the embodiment described above, a case when a regular image 35 is developed in black, however, when the regular image 35 is developed in color, a prewarning image will be developed in black. The embodiment also describes the case that two developing units 4,5 are provided around the photoconductive drum 1 to perform printing in two colors. However, three or four developing units may be arranged around the photoconductive drum 1 to carry out a printing in three or four colors simultaneously.

In the embodiment, it was also arranged, when the first developing unit 4 is not in action and the developing motor is stopped, to move the magnetic pole from the developing area X to the position opposite to the height regulating member 49 by rotating the magnet roller 43, however, the magnetic pole is not necessarily be moved whether the developing unit is in action or not as described in the embodiment. However, the present embodiment is advantageously be able to prevent the magnetic brush from contacting with the photoconductive drum 1 in much less probability and mixture of color can be avoided.

Figure 9:
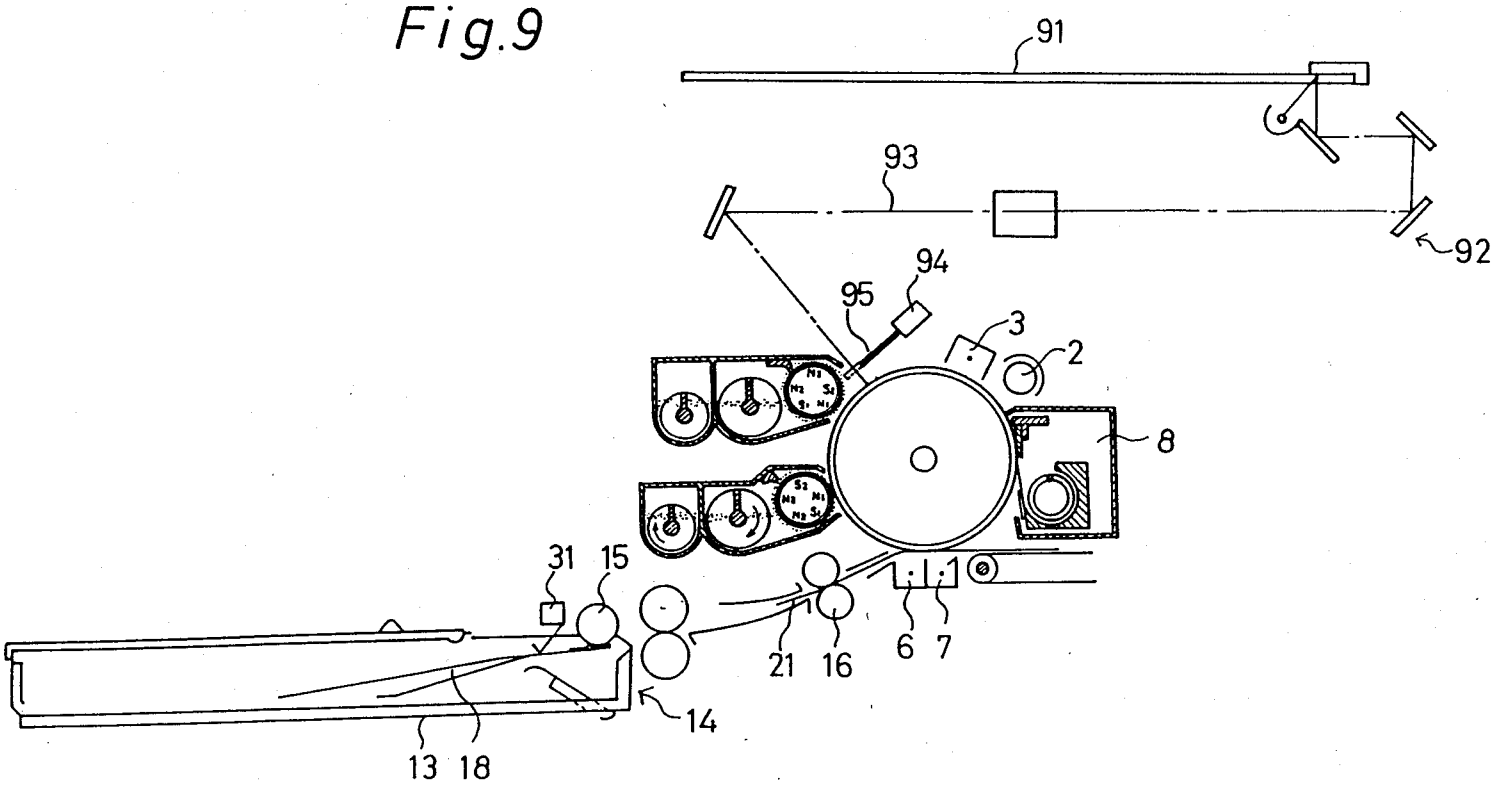
FIG. 9 is a schematic structural view showing the second embodiment of the present invention applied to a copying machine.

FIG. 9 shows the second embodiment of the present invention to which a copying machine is applied. In this embodiment, an image forming section, a paper feeding section and a developing section are arranged in the same manner as that of the first embodiment excepting a difference in image exposure system in the image forming section wherein an original is placed on an original glass table 91 disposed above the photoconductive drum 1 and a slit exposure is made to an image of the original by a mirror scanning type projection optical system 92 by successively exposing the image onto the photoconductive drum 1.

A prewarning image is formed by operating a light shield pattern plate 95 arranged adjacent to an image forming section on a projection light path 93 in the projection optical system 92. The light shield pattern plate 95 is turned in and out of the light path 93 corresponding to turning on and off of a solenoid 94. When a prewarning image is marked, the light shield pattern 95 is entered into the light path 93 by turning on the solenoid 94 and intercept exposure to the photoconductive drum 1 while the light shield pattern 95 is in the light path 93. At this stage, the portion of the light shield pattern 95 intercepted exposure is developed and the same belt-shaped prewarning image is formed as illustrated in FIG. 5, wherein the development is made in different color from that of a regular image as in the first embodiment.

Figure 10:
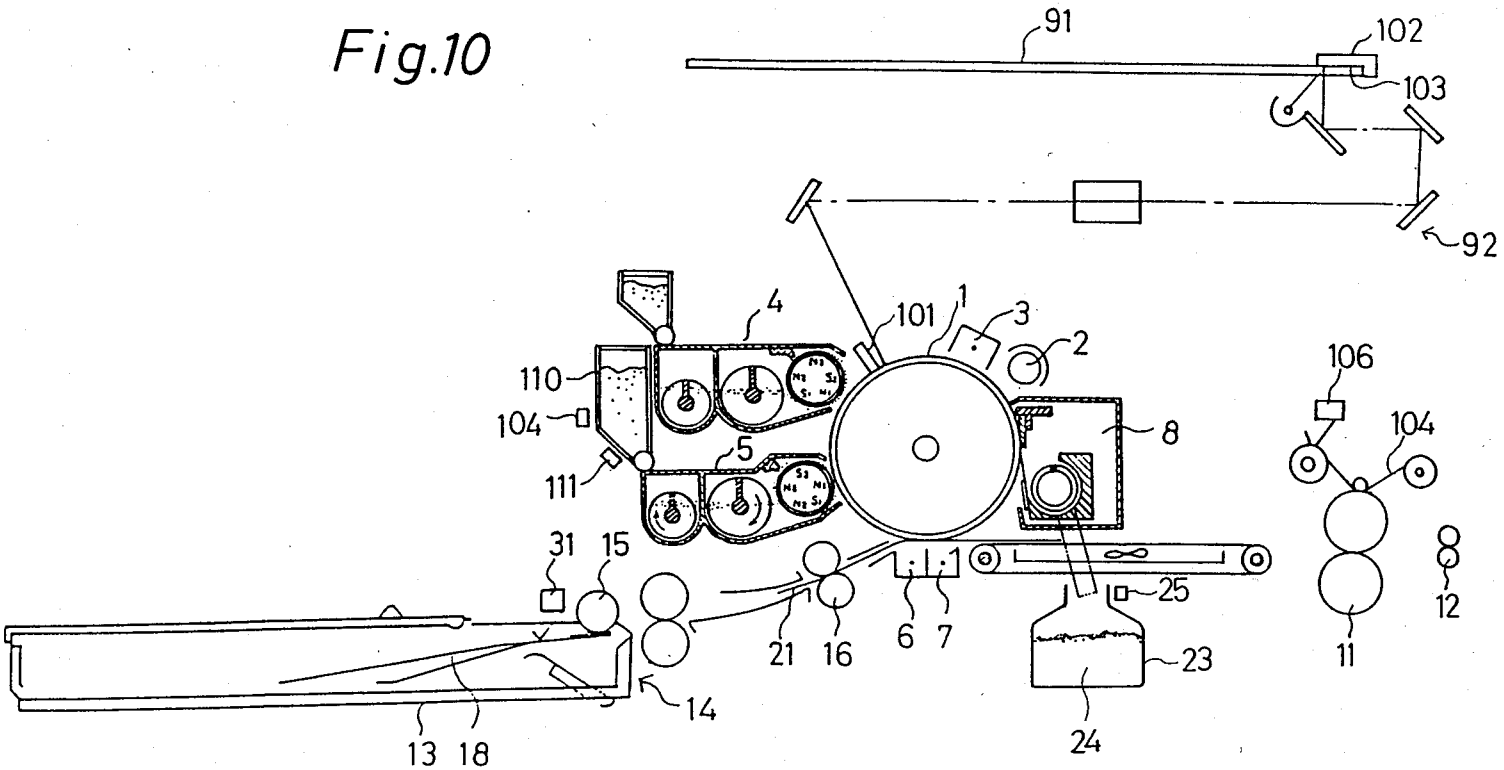

FIG. 10 shows the third embodiment of the present invention to which the same sort of copying machine is applied as in the second embodiment wherein a suberaser 101 for eliminating an electric charge on the portion corresponding to the portion between images on the photoconductive drum 1 is provided.

For copying a prewarning image, a prewarning image pattern 103 is prepared and placed undersurface of an original scale 102 on an original glass table 91 and is exposed on a photoconductive drum 1 together with an original image, however, it will not be copied on a sheet when an ordinary copying of the original image is made since the exposure area of the prewarning image is deviated from an ordinary copying area. Accordingly, when a prewarning image is marked, an electrostatic latent image of the prewarning image is transferred onto a leading edge of a sheet after development by staggering the timing of sheet feeding.

Figure 11:
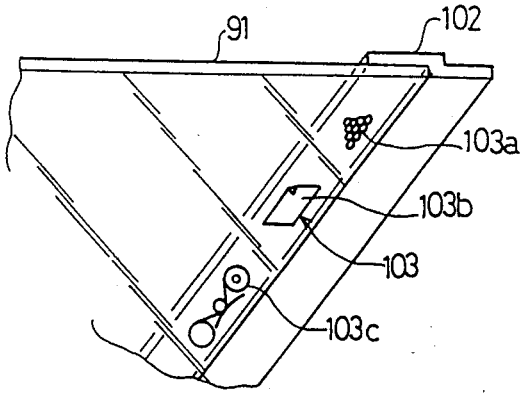
FIG. 11 is a perspective view showing a portion of an original glass table of the copying machine in FIG. 10 seen from below.

The suberaser 101 in this embodiment comprises a plurality of LED arranged in parallel with an axis of rotation of the photoconductive drum, and each LED may selectively be turned on with proper timing. As for the patterns 103 of prewarning image provided undersurface of the original scale 102, patterns **103*a*, 103*b* and 103*c* are arranged to correspond with sensors 31, 105 and 106 provided for detecting near empty state of sheet 21, toner 19 as well as for detecting exchange requirement of cleaning web 104 of a fixing device 11 as shown in FIG. 11**.

Figure 12:
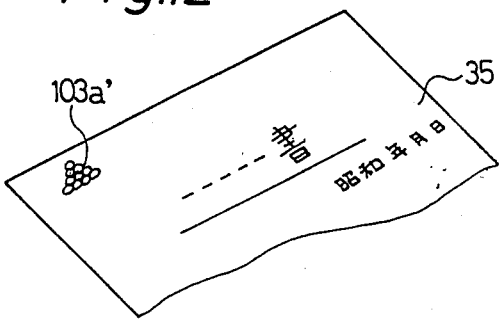
FIG. 12 is a perspective view showing an example of indication of prewarning image formed by the copying machine in FIG. 10.

When a detection is made on any one of the items described, electrostatic latent images of the **103*a*, 103*b* and 103*c* placed undersurface of the original scale 102 are formed on the photoconductive drum 1. The images corresponding to the position of the suberaser 101 are then erased by turning on the LED leaving one image related to the result of detection which is thereafter developed and transferred onto a sheet 21 such as prewarning image 103*a*' for indicating toner near empty state as shown in FIG. 12**. Prewarning can thus be made for a plurality of near empty states.

Apart from an empty detecting sensor 111, a sensor 105 is provided for a toner replenishing tank 110 of the second developing unit 5 where considerable amount of toner is consumed. Such sensor may be provided for the first developing unit 4 as well. In such a case, however, it is necessary to indicate by numerals and marks with which developing unit the prewarning for toner near empty is made.

In this embodiment, a sensor 25 is disposed adjacent a toner bottle 23 which accommodates residual toner 24 removed from a photoconductive drum 1 by a cleaning device 8 for detecting that the bottle is almost full of toner. It may also be arranged to indicate by a prewarning image that the residual toner bottle is almost full as it is done on the near empty state of sheet of paper.

In the above embodiment, description are made only on the cases where laser beam printers and copying machines are employed. However, it may also be applicable to other use such as in facsimile or in other system of image forming apparatus. In case of facsimile, the indication of address, time and date of transmission is made on the edge of a sheet so that there will be no inconvenience even if a prewarning image is formed thereon.

In case when a regular image is printed in a single color or in a plurality of colors, a spare developing unit provided with different color toner for prewarning image from that of regular image may also be provided.

When an image forming apparatus of thermo-sensitive coloring system is utilized, it may be arranged to distinguish the colors of a regular image and a prewarning image by arranging the images in more than two colors with selection of coloring temperature in an image forming operation.

In case when a plurality of sheet cassettes are disposed for prewarning near empty state of sheet of paper, it is necessary to indicate which cassette is utilized. The characters 'upper', 'lower' and the like may be considered to be printed in a sheet mark in this case.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a first image forming means for forming a first image corresponding to an original or image information to be copied on a sheet;

a detecting means for detecting a specific condition of the image forming apparatus;

a second image forming means for forming a second image indicative of said specific condition; and a control means for controlling said first and second image forming means to form the second image together with the first image on the sheet in accordance with the detection of said specific condition by said detecting means.

2. An image forming apparatus, comprising:

a first image forming means for forming a first image corresponding to an original or image information to be copied on a sheet;

a detecting means for detecting near emptiness of expendable supplies used in forming the first image;

a second image forming means for forming a predetermined second image indicative of said near emptiness; and a control means for controlling said first and second image forming means to form the second image together with the first image on the sheet in accordance with the detection by said detecting means.

3. An apparatus according to claim 2, wherein said second image forming means forms said second image in different color from the color of said first image.

4. An image forming apparatus, comprising:

a first image forming means for forming a first image corresponding to an original or image information to be copied on a sheet;

a detecting means for detecting various conditions which require supply of expendable supplies used in forming the first image;

a second image forming means for forming a predetermined second image indicative of one of said conditions; and a control means for controlling said second image forming means upon the detection by said detecting means so as to form the second image which has the message corresponding to the condition detected together with the first image on the sheet.

5. An apparatus according to claim 4, wherein said condition is near emptiness of expendable supplies or near fulfillment of a receptacle of waste.

6. An image forming apparatus, comprising:

an image forming means;

a detecting means for detecting a condition which require supply of expendable supplies;

a memory means for storing image data corresponding to an appointed image indicative of said condition; and a control means for controlling said image forming means to form an image which corresponds to an image information to be formed and said appointed image in conformity with said image data on the same sheet in accordance with the detection of said condition by said detecting means.

* * * * *